US009102137B2

(12) United States Patent
Koitabashi et al.

(10) Patent No.: US 9,102,137 B2
(45) Date of Patent: Aug. 11, 2015

(54) TRANSFER IMAGE FORMING METHOD, TRANSFER IMAGE FORMING APPARATUS, AND INTERMEDIATE TRANSFER MEMBER TO BE USED THEREIN

(71) Applicant: CANON KABUSHIKI KAISHA, Tokyo (JP)

(72) Inventors: Noribumi Koitabashi, Yokohama (JP); Haruhiko Terai, Yokohama (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/161,013

(22) Filed: Jan. 22, 2014

(65) Prior Publication Data

US 2014/0218424 A1 Aug. 7, 2014

(30) Foreign Application Priority Data

Feb. 7, 2013 (JP) ..... 2013-022272
Mar. 1, 2013 (JP) ..... 2013-040716

(51) Int. Cl.
*B41J 2/01* (2006.01)
*B41J 2/005* (2006.01)
*B41J 1/00* (2006.01)

(52) U.S. Cl.
CPC . *B41J 2/0057* (2013.01); *B41J 1/00* (2013.01)

(58) Field of Classification Search
CPC ..... G03G 15/20; B41J 2/0057; A01B 12/006
USPC ..... 347/1, 101, 103, 106; 399/333
See application file for complete search history.

(56) References Cited

U.S. PATENT DOCUMENTS

| | | | | |
|---|---|---|---|---|
| 5,233,397 | A * | 8/1993 | Till | 399/307 |
| 5,353,105 | A * | 10/1994 | Gundlach et al. | 399/296 |
| 6,792,238 | B2 * | 9/2004 | Samei et al. | 399/329 |
| 7,494,213 | B2 | 2/2009 | Taniuchi et al. | |
| 7,558,520 | B2 * | 7/2009 | Sugawara et al. | 399/333 |
| 8,050,612 | B2 * | 11/2011 | Kinouchi et al. | 399/333 |
| 8,220,917 | B2 | 7/2012 | Taniuchi et al. | |
| 2008/0117273 | A1 * | 5/2008 | Yamashita et al. | 347/96 |
| 2009/0080954 | A1 * | 3/2009 | Miyata et al. | 399/329 |

FOREIGN PATENT DOCUMENTS

| | | |
|---|---|---|
| JP | 6-122194 A | 5/1994 |
| JP | 2004-114675 A | 4/2004 |

* cited by examiner

*Primary Examiner* — Alessandro Amari
*Assistant Examiner* — Michael Konczal
(74) *Attorney, Agent, or Firm* — Fitzpatrick, Cella, Harper & Scinto

(57) ABSTRACT

A transfer image forming apparatus includes ink applying unit for applying ink to an intermediate transfer member to form an intermediate image; a heating unit for irradiating the intermediate transfer member with at least infrared light to heat the intermediate image; and a transferring unit for pressing a recording medium against the intermediate transfer member having formed thereon the intermediate image to transfer the intermediate image onto the recording medium. The intermediate transfer member includes a substrate, and at least a second layer, a metal layer, and a first layer as a surface layer provided in the listed order on the substrate. The heat conductivity of the second layer is smaller than that of the first layer.

7 Claims, 2 Drawing Sheets

TRANSFER IMAGE FORMING METHOD, TRANSFER IMAGE FORMING APPARATUS, AND INTERMEDIATE TRANSFER MEMBER TO BE USED THEREIN

BACKGROUND OF THE INVENTION

1. Field of the Invention

The present invention relates to a transfer image forming method, a transfer image forming apparatus, and an intermediate transfer member to be used therein.

2. Description of the Related Art

Bleeding, which means such a phenomenon that inks applied adjacently to each other are mixed with each other, and beading, which means such a phenomenon that an ink that has impacted earlier is attracted by an ink that has impacted later, are known as problems at the time of the formation of an image by an ink jet system. In addition, there are problems such as curling and cockling due to excessive absorption of a liquid component in an ink by a recording medium.

A transfer ink jet printing method has been devised for solving the problems. The printing method includes the following steps:

(1) an intermediate image forming step of applying an ink containing a coloring material component onto an intermediate transfer member with an ink jet device to form an intermediate image; and (2) a transferring step of pressing the intermediate transfer member having formed thereon the intermediate image against a recording medium to transfer the intermediate image onto the recording medium.

Here, in the transfer ink jet printing method, an improvement in transferability of the intermediate image onto the recording medium is an important objective.

Japanese Patent Application Laid-Open No. 2004-114675 exemplifies a transfer ink jet recording apparatus. In a printing method involving using the apparatus, after a wettability-improving component has been applied to an intermediate transfer member, an ink-flowability-reducing component is further applied onto the wettability-improving component and then an ink-jet-drawn image is transferred onto a recording medium with a pressure. Japanese Patent Application Laid-Open No. H06-122194 discloses that an intermediate transfer member is obtained by laminating an elastic layer on a metal element tube, and that an ink image formed on the elastic layer is heated by photoirradiation and then transferred.

The related art described in the foregoing involves such problems as described below. That is to say, in the transfer ink jet recording apparatus in Japanese Patent Application Laid-Open No. 2004-114675, the construction of a basic transfer recording apparatus is described. However, Japanese Patent Application Laid-Open No. 2004-114675 has no description concerning a technology for improving the transferability or detachability of an ink image from the intermediate transfer member. The transferability or the detachability is of concern particularly upon continuous printing at a high speed, and such problem has not been sufficiently investigated in the related art.

In the construction of the intermediate transfer member of Japanese Patent Application Laid-Open No. H06-122194, the thin elastic layer is laminated on the thick metal element tube. Accordingly, when an ink layer to be transferred is as thin as about 1 to 3 μm, the elastic layer cannot follow the irregularities of a paper surface at the time of the transfer and hence a transfer failure occurs.

SUMMARY OF THE INVENTION

The inventors of the present invention have made extensive studies on the problems of the related art. As a result, the inventors have found that an intermediate transfer member has only to be constructed as described below. The intermediate transfer member is constructed so that the intermediate transfer member has more elasticity, the temperatures of an intermediate image and the intermediate transfer member easily increase until the intermediate image is transferred, and the intermediate transfer member easily cools at the time of the transfer of the intermediate image. Therefore, an object of the present invention is to provide an intermediate transfer member with improved transferability and detachability of an intermediate image, a transfer image forming method involving using the member, and a transfer image forming apparatus including the member.

The inventors of the present invention have made extensive studies in deep consideration of the problems of the related art described in the foregoing. As a result, the inventors have found that the problems can be solved with a transfer image forming method, a transfer image forming apparatus, and an intermediate transfer member to be used therein, the method, the apparatus, and the member having the following constructions, and have completed the present invention. That is to say, one embodiment of the present invention relates to a transfer image forming apparatus, including an ink applying unit for applying an ink to an intermediate transfer member to form an intermediate image; a heating unit for irradiating the intermediate transfer member with at least infrared light to heat the intermediate image; and a transferring unit for pressing a recording medium against the intermediate transfer member having formed thereon the intermediate image to transfer the intermediate image onto the recording medium, in which: the intermediate transfer member includes a substrate, and at least a second layer, a metal layer, and a first layer as a surface layer provided in the stated order on the substrate; and a heat conductivity of the second layer is smaller than a heat conductivity of the first layer.

Another embodiment of the present invention relates an intermediate transfer member for a transfer image forming apparatus including an ink applying unit for applying an ink to an intermediate transfer member to form an intermediate image; a heating unit for irradiating the intermediate transfer member with at least infrared light to heat the intermediate image; and a transferring unit for pressing a recording medium against the intermediate transfer member having formed thereon the intermediate image to transfer the intermediate image onto the recording medium, the intermediate transfer member including a substrate, and at least a second layer, a metal layer, and a first layer as a surface layer provided in the stated order on the substrate, in which a heat conductivity of the second layer is smaller than a heat conductivity of the first layer.

Still another embodiment of the present invention relates to a transfer image forming method including an intermediate image forming step of applying an ink to an intermediate transfer member to form an intermediate image; a heating step of irradiating the intermediate transfer member with at least infrared light to heat the intermediate image; and a transferring step of pressing a recording medium against the intermediate transfer member having formed thereon the intermediate image to transfer the intermediate image onto the recording medium, wherein the intermediate transfer member includes a substrate, and at least a second layer, a metal layer, and a first layer as a surface layer provided in the stated order on the substrate, and a heat conductivity of the second layer is smaller than a heat conductivity of the first layer.

The transfer image forming method, the transfer image forming apparatus, and the intermediate transfer member to be used therein, which improve transferability and detachability of an ink image, can be provided.

Further features of the present invention will become apparent from the following description of exemplary embodiments with reference to the attached drawings.

DESCRIPTION OF THE EMBODIMENTS

Figure 1:
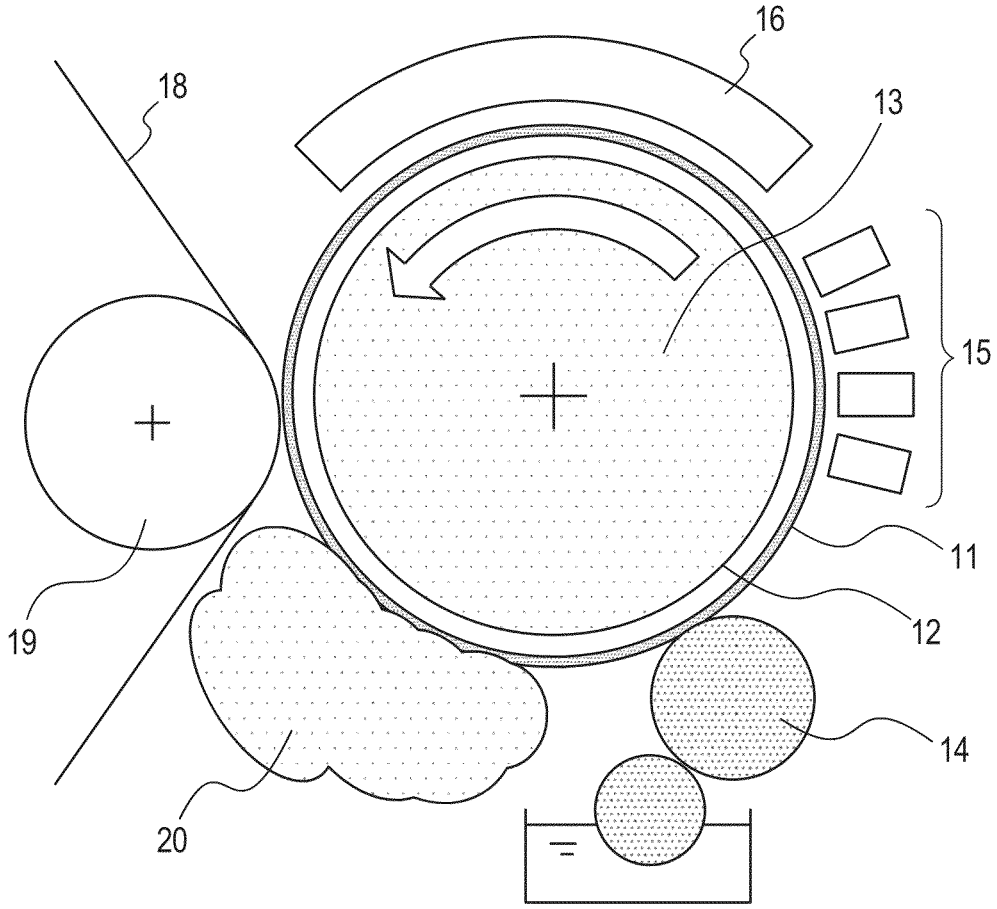
FIG. 1 is a schematic view illustrating an example of a transfer image forming apparatus of the present invention.

An example of a transfer image forming apparatus of the present invention includes an ink applying unit, a heating unit, and a transferring unit. The ink applying unit applies an ink containing a coloring material component onto an intermediate transfer member to form an intermediate image. The heating unit irradiates the intermediate transfer member with at least infrared light to heat the intermediate image. The transferring unit presses a recording medium onto the intermediate transfer member having formed thereon the intermediate image to transfer the intermediate image onto the recording medium. The intermediate transfer member includes at least a substrate, and a second layer, a metal layer, and a first layer as a surface layer provided on the substrate in the stated order. The heat conductivity of the second layer of the intermediate transfer member is smaller than that of the first layer.

In addition, an example of an intermediate transfer member of the present invention is an intermediate transfer member for the transfer image forming apparatus.

An example of a transfer image forming method of the present invention includes an intermediate image forming step, a heating step, and a transferring step. In the intermediate image forming step, an ink containing a coloring material component is applied to an intermediate transfer member to form an intermediate image. In the heating step, the intermediate transfer member is irradiated with at least infrared light to be heated. In the transferring step, a recording medium is pressed against the intermediate transfer member having formed thereon the intermediate image to transfer the intermediate image onto the recording medium. The intermediate transfer member to be used in the transfer image forming method is the same as the intermediate transfer member to be used in the transfer image forming apparatus.

The following action and effect are exerted at the time of the formation of an image with the transfer image forming method, transfer image forming apparatus, and intermediate transfer member of the present invention. That is to say, at the time of the formation of the image, first, an ink image (intermediate image) is formed on the intermediate transfer member. Next, the ink on the intermediate transfer member is irradiated with infrared light to be heated. At this time, the infrared light is reflected by the metal layer, which is a lower layer of the first layer as the surface layer, to abruptly increase the temperature of the surface layer within a short time period, and hence the temperature of the ink image on the intermediate transfer member easily increases. Accordingly, the ink image easily softens.

However, on the other hand, the heat of the surface layer is conducted to a substrate side during a time period before the transferring step. Accordingly, if the temperature of the surface layer at the time of the transfer reduces, the softening of the ink image (intermediate image) becomes insufficient and its adhesiveness to the recording medium reduces, thereby causing a reduction in transferability. In contrast, the intermediate transfer member of the present invention is constructed so that the heat conductivity of the second layer under the metal layer is smaller than the heat conductivity of the surface layer on the metal layer. Therefore, the heat does not escape to a side closer to the second layer and the temperature of the surface layer hardly reduces. Accordingly, the thermal softening of the ink image becomes sufficient and its adhesiveness to the recording medium improves.

In addition, upon contact of the intermediate transfer member with the recording medium at the time of the transfer, heat conduction from the second layer to the surface layer hardly occurs because the second layer has a small heat conductivity. Therefore, at the time of the transfer, the temperature of the surface layer sharply reduces by virtue of the conduction of the heat of the surface layer to a recording medium side. As a result, a sharp reduction in temperature of the ink image occurs and the cohesive force of the ink image enlarges in association with the reduction. Accordingly, the ink image can be easily detached from the intermediate transfer member, and hence its transferability and detachability improve. Further, when the transfer image forming method or the like of the present invention is increased in speed, in the case where the intermediate transfer member is of a drum or roller shape, the time period for which the intermediate transfer member and the recording medium are in contact with each other at the time of the transfer shortens, and hence the reduction of the temperature of the surface layer of the intermediate transfer member becomes more abrupt. Therefore, the transferability and detachability of the intermediate image are additionally improved in the transfer image forming method or the like of the present invention increased in speed.

For example, an ink jet device can be used as the ink applying unit.

The transfer image forming method and the transfer image forming apparatus preferably include a treatment liquid applying step of applying a treatment liquid for increasing the viscosity of ink and a treatment liquid applying unit for applying the liquid, respectively. In addition, the transfer image forming method and the transfer image forming apparatus preferably include a cooling step of cooling the surface of the intermediate transfer member after the transfer and a cooling unit for cooling the surface after the transfer, respectively.

FIG. 1 is a schematic view illustrating an example of the transfer image forming apparatus of the present invention. In a transfer image forming method involving using the apparatus of FIG. 1, image formation is performed through the following steps (1) to (6).

(1) Treatment liquid applying step: A treatment liquid is applied onto the surface layer of an intermediate transfer member 11.

(2) Intermediate image forming step: An ink is selectively applied onto the surface layer of the intermediate transfer member 11 onto which the treatment liquid has been applied.

Thus, an intermediate image is formed on the surface layer of the intermediate transfer member 11.

(3) Heating step: The intermediate transfer member 11 and the intermediate image are heated.

(4) Transferring step: The intermediate image formed on the intermediate transfer member 11 is transferred onto a recording medium 18.

(5) Cooling step: The intermediate transfer member 11 after the transfer of the intermediate image is cooled.

(6) Washing and reproducing step: The intermediate transfer member 11 after the transferring step is washed and reproduced so as to be repeatedly usable.

Hereinafter, the steps (1) to (6) are described in detail with reference to the respective portions of the transfer image forming apparatus of FIG. 1.

In the transfer image forming apparatus of FIG. 1, the intermediate transfer member 11 is formed of a rotatable and drum-shaped substrate 12, a surface layer (first layer) formed to be the outermost layer of the substrate 12, and multiple layers positioned therebetween. Specific constructions of the surface layer (first layer) and the multiple layers thereunder are described later with reference to FIG. 2.

The substrate 12 is formed of a cylindrical drum formed of an aluminum alloy so as to satisfy the improvements of rigidity and dimensional accuracy capable of resisting pressurization at the time of the transfer, and the improvement of the responsiveness of control through the alleviation of the inertia of its rotation. It should be noted that the shape of the substrate 12 is not limited to a drum, and the substrate 12 of, for example, a roller or belt shape can also be suitably used according to the form of an image forming apparatus to be applied or the aspect of the transfer onto the recording medium. The same intermediate transfer member 11 can be continuously and repeatedly used irrespective of the shape of the substrate to be used, and hence the productivity of the image formation can be improved. The substrate 12 is rotationally driven in the direction indicated by the arrow about an axis 13, and each device placed around the substrate is adapted to operate in synchronization with the rotation.

A roller-type applying apparatus (treatment liquid applying unit) 14 is placed as a device for applying the treatment liquid so as to be in contact with the outer peripheral surface of the surface layer of the intermediate transfer member 11. Thus, the treatment liquid is continuously applied to the outer peripheral surface of the intermediate transfer member 11 (treatment liquid applying step).

Next, an ink for forming the intermediate image is ejected from an ink jet device (ink applying unit) 15 placed so as to be opposite to the outer peripheral surface of the surface layer of the intermediate transfer member 11. Thus, on the intermediate transfer member 11, the treatment liquid and the ink act to form the intermediate image (image in a mirror-reverse relationship with a desired image to be finally formed) (intermediate image forming step). The ink jet device 15 used in the transfer image forming apparatus of FIG. 1 was of such a type that ink ejection was performed with a thermoelectric conversion element by an on-demand system.

Next, the intermediate transfer member 11 and the intermediate image are heated from the surface side of the intermediate transfer member 11 with an infrared light irradiation apparatus and air blowing apparatus (heating unit) 16 placed so as to be opposite to the outer peripheral surface of the surface layer of the intermediate transfer member 11 (heating step). Thus, the amount of liquid components in the ink constituting the intermediate image on the intermediate transfer member 11 is reduced to dry the ink, and resin components in the intermediate image softens. It should be noted that in the apparatus of FIG. 1, the apparatus 16 is used both for drying and heating from the viewpoint of a reduction in size. In addition, although the infrared light irradiation apparatus and air blowing apparatus 16 is provided in FIG. 1, an infrared light irradiation apparatus and a warm air apparatus may be provided in such a form as to be used in combination. However, the drying and the heating may be performed with apparatus different from each other from the viewpoint of separating the functions of the drying and the heating.

Next, while the recording medium 18 is allowed to pass through a gap between the intermediate transfer member 11 and a pressure roller 19 placed so as to be opposite to the outer peripheral surface of the surface layer of the intermediate transfer member 11, the intermediate transfer member 11 and the pressure roller 19 are rotated. A roller that is constituted of a metal roll made of aluminum, alumina, or the like, and whose surface layer has been subjected to an alumite treatment can be used as the pressure roller. Thus, the intermediate image formed on the intermediate transfer member 11 is brought into contact with the recording medium 18, and the image is transferred and formed onto the recording medium 18. In the apparatus of FIG. 1, pressurization is performed so that the intermediate image and the recording medium 18 be interposed between the substrate 12 and the pressure roller 19, and hence the intermediate image on the intermediate transfer member 11 is efficiently transferred onto the recording medium 18.

Next, the intermediate transfer member 11 after the transfer of the intermediate image is cooled with a cooling belt (cooling unit) (not shown) placed so as to be in contact with the outer peripheral surface of the surface layer of the intermediate transfer member 11 (cooling step). The temperature of the cooling belt is preferably set to 25° C. to 50° C. For example, when the temperature of the cooling belt is set to 25° C., merely bringing the belt into contact with the intermediate transfer member 11 for a relatively short time period reduces the surface temperature of the intermediate transfer member 11, which has been 80° C. after the transferring step, to 50° C. It should be noted that the temperature of the cooling belt has only to be appropriately set depending on conditions such as the temperature of the intermediate transfer member after the transferring step, and the time period for which the intermediate transfer member 11 and the cooling belt are in contact with each other as described above.

Next, the intermediate transfer member 11 after the transferring step is washed with a cleaning unit 20 placed so as to be opposite to the outer peripheral surface of the surface layer of the intermediate transfer member 11. The cleaning unit 20 of FIG. 1 is such that a damping roller always in wet conditions with ion-exchanged water is adapted to intermittently abut on the outer peripheral surface of the surface layer of the intermediate transfer member 11. Thus, the intermediate transfer member 11 can be repeatedly used (subjected to intermediate image formation).

The amount of the liquid component in the ink image on the intermediate transfer member 11 reduces and the ink image softens by virtue of the heating with the infrared light irradiation apparatus and air blowing apparatus (heating unit) 16. Accordingly, even when an image is formed on the recording medium 18 that hardly absorbs an ink such as a PET film, the intermediate image can be transferred from the intermediate transfer member 11 onto the recording medium 18 with excellent transferability and excellent detachability. As a result, a good image can be formed.

Figure 2:
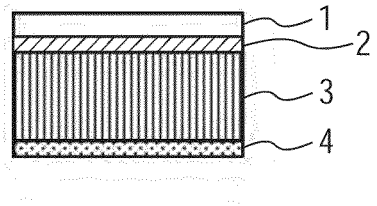
FIG. 2 is a sectional view illustrating an example of an intermediate transfer member of the present invention.

FIGS. 2 to 5 are partial sectional views illustrating specific layer constructions of the intermediate transfer member 11 of FIG. 1. An intermediate transfer member of FIG. 2 is of such a layer construction that a surface layer 1 as a first layer, a metal layer 2, a heat insulating layer 3 as a second layer, and a substrate 4 are provided in the stated order from the surface side of the intermediate transfer member.

Figure 3:
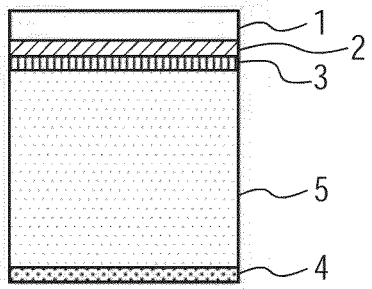
FIG. 3 is a sectional view illustrating another example of the intermediate transfer member of the present invention.

An intermediate transfer member of FIG. 3 is of such a layer construction that the surface layer 1 as the first layer, the metal layer 2, the heat insulating layer 3 as the second layer, a pressure relaxing layer 5 as a third layer, and the substrate 4 are provided in the stated order from the surface side of the intermediate transfer member.

Figure 4:
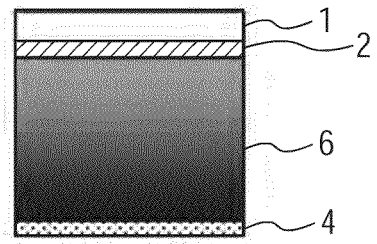
FIG. 4 is a sectional view illustrating another example of the intermediate transfer member of the present invention.

An intermediate transfer member of FIG. 4 is of such a layer construction that the surface layer 1 as the first layer, the metal layer 2, a heat insulating and pressure relaxing layer 6 as a second/third common layer, and the substrate 4 are provided in the stated order from the surface side of the intermediate transfer member. Here, the heat insulating layer and pressure relaxing layer as the second/third common layer is constructed so as to function as a heat insulating layer as well by reducing the compressibility of a surface layer portion in the pressure relaxing layer as the third layer to reduce its heat conductivity.

Figure 5:
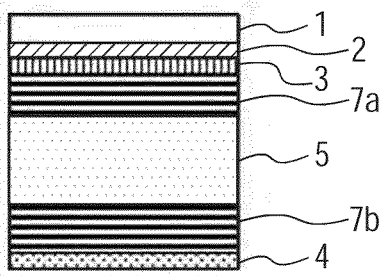
FIG. 5 is a sectional view illustrating another example of the intermediate transfer member of the present invention.

An intermediate transfer member of FIG. 5 is of such a layer construction that the surface layer 1 as the first layer, the metal layer 2, the heat insulating layer 3 as the second layer, a composite layer of a cloth layer 7*a*, the pressure relaxing layer 5, and a cloth layer 7*b* as the third layer, and the substrate 4 are provided.

1. Transfer Image Forming Apparatus and Intermediate Transfer Member

Hereinafter, the transfer image forming apparatus and intermediate transfer member according to an embodiment of the present invention are described in detail.

Intermediate Transfer Member

The intermediate transfer member in this embodiment holds an ink or holds an ink and a treatment liquid, and serves as a base material on which an intermediate image is formed. The intermediate transfer member includes a substrate for transmitting a force needed for handling the intermediate transfer member, and at least a second layer, a metal layer, and a first layer as a surface layer provided in the stated order on the substrate. The second layer, the metal layer, and the first layer constitute a surface layer member for forming an image. Each of the substrate, the first layer, the metal layer, and the second layer may be formed of one layer of a uniform material, or may be formed of multiple layers independent of each other. In addition, the heat conductivity of the second layer is smaller than that of the first layer.

Examples of the shape of the intermediate transfer member, which is not particularly limited, include a sheet shape, a roller shape, a drum shape, a belt shape, and an endless web shape. In addition, the size of the intermediate transfer member can be freely selected according to a target printed image size.

Hereinafter, each layer constituting the intermediate transfer member is described in more detail.

(i) Substrate

The substrate of the intermediate transfer member is required to have some degree of structural strength from the viewpoints of conveying accuracy and durability. A metal, a ceramic, a resin, or the like is suitable as a material for the substrate, though the material is not particularly limited. Of those, in particular, the following materials are extremely suitably used in terms of characteristics required to improve rigidity and dimensional accuracy capable of resisting pressurization at the time of transfer, and to improve the responsiveness of control through the alleviation of inertia at the time of operation: aluminum, iron, stainless steel, an acetal resin, an epoxy resin, polyimide, polyethylene, polyethylene terephthalate, nylon, polyurethane, a silica ceramic, an alumina ceramic, or a combination thereof.

(ii) First Layer (Surface Layer)

The first layer (surface layer) of the intermediate transfer member desirably has some degree of elasticity in addition to a larger heat conductivity than that of the second layer, for transferring an image by pressing the image against a recording medium such as paper. For example, when paper is used as the recording medium, the hardness of the first layer is as follows: its durometer type A hardness (in conformity with JIS K6253) is preferably 10° or more and 100° or less, particularly more preferably 20° or more and 60° or less.

Various materials such as a resin and a ceramic can appropriately be used as the material for the first layer, and various elastomer materials and rubber materials are preferably used from the viewpoints of the above-mentioned characteristics and process characteristics. Examples of the rubber material include a fluorosilicone rubber, a phenylsilicone rubber, a fluororubber, a chloroprene rubber, a nitrile rubber, an ethylene propylene rubber, a natural rubber, a styrene rubber, an isoprene rubber, a butadiene rubber, an ethylene/propylene/butadiene copolymer, and a nitrile butadiene rubber. In particular, a silicone rubber, a fluorosilicone rubber, a phenylsilicone rubber, a fluororubber, or a chloroprene rubber can be extremely suitably used from the viewpoints of, for example, dimensional stability, durability, and heat resistance. It is also suitable that the first layer is constituted of multiple layers formed by laminating multiple materials. For example, a laminated material obtained by forming a thin coating film of a silicone rubber on a polyurethane rubber can be extremely suitably used as the first layer.

In addition, the first layer can be subjected to a proper surface treatment. Examples of the surface treatment include a flame treatment, a corona treatment, a plasma treatment, a polishing treatment, a roughening treatment, an active energy ray irradiation treatment (e.g., UV, IR, or an RF), an ozone treatment, and a surfactant treatment. In addition, the layer may be subjected to a combination of two or more of those surface treatments.

(iii) Metal Layer

The intermediate transfer member and the ink image (intermediate image) can be heated more efficiently by reflecting infrared light radiated from the heating unit with the metal layer. In addition, the performance of transferring the intermediate image from the intermediate transfer member onto the recording medium can be improved by a synergistic effect with the second layer positioned under the metal layer.

Gold, aluminum, silver, chromium, nickel, or the like is preferred as a material for the metal layer. In addition, not only those materials but also metal alloy materials such as stainless steel, an aluminum alloy, and an iron alloy may be used. When the metal layer is excessively thin, its substantial density as a film becomes insufficient and hence its reflection characteristic reduces. Accordingly, the thickness of the metal layer is preferably 0.3 μm or more. In addition, the metal layer desirably has such a thickness that the elasticity and the like of the intermediate transfer member are not largely affected, and its thickness is substantially preferably 0.3 μm or more and 200 μm or less.

(iv) Heat Insulating Layer (Second Layer)

The heat conductivity of the heat insulating layer is smaller than that of the surface layer. Accordingly, heat conduction from the surface layer to the heat insulating layer can be suppressed before the transfer of the intermediate image, and heat conduction from the heat insulating layer to the surface layer can be suppressed at the time of the transfer of the intermediate image. Therefore, the temperatures of the intermediate transfer member and the intermediate image can be sharply increased at the time of heating with the heating unit, and the temperatures can be maintained until the intermediate image is transferred. In addition, at the time of the transfer of the intermediate image, good transferability and good detachability onto the recording medium can be obtained by sharply reducing the temperature of the intermediate image. As a result, even when image formation is performed at a high speed by repeatedly using the intermediate transfer member, good transferability and good detachability can be stably maintained. A layer formed of, for example, a foamed polystyrene having a thickness of 0.1 mm or more and 0.2 mm or less (heat conductivity: 0.03 W/m·K) or a rigid urethane foam (heat conductivity: 0.026 W/m·K) is preferred as the heat insulating layer. In addition, the heat conductivity of the heat insulating layer is preferably 0.08 W/m·K or less. In addition, the pressure relaxing layer as a lower layer of the heat insulating layer may not be provided. In that case, the heat insulating layer preferably has a thickness of 0.5 mm or more because the layer functions as a pressure relaxing layer by virtue of its some degree of elasticity.

(v) Other Layer

The intermediate transfer member can include any other layer except the members (i) to (iv). For example, the member can include a pressure relaxing layer or a cloth layer as the other layer.

The pressure relaxing layer is a layer provided for relaxing a variation in pressure upon transfer of the intermediate image onto the recording medium, which can reduce transfer unevenness. In addition, the pressure relaxing layer as well as the second layer preferably have elasticity in order that the surface layer can follow the irregularities of the surface of paper. Although the position at which the pressure relaxing layer is provided in the intermediate transfer member is not particularly limited, the layer is preferably provided between the heat insulating layer and the substrate. The heat conductivity of the pressure relaxing layer (heat conductivity of the third layer), which is not particularly limited, is preferably made larger than that of the heat insulating layer (second layer). In addition, the material for the pressure relaxing layer is of a rubber, a resin, or the like, and specifically, an NBR, foamed urethane, or the like is preferred. In addition, the thickness of the layer is preferably 1 mm or more and 2 mm or less.

The cloth layer is a layer provided for relaxing the variation in pressure upon transfer of the intermediate image as in the pressure relaxing layer. Although the cloth layer can reduce the transfer unevenness, the material therefor is a cloth unlike the pressure relaxing layer. Although the position at which the cloth layer is provided in the intermediate transfer member is not particularly limited, the layer is preferably provided between the heat insulating layer and the substrate. The heat conductivity of the cloth layer (heat conductivity of the third layer), which is not particularly limited, is preferably made larger than that of the heat insulating layer (second layer). In addition, the material for the cloth layer is of a cloth, and specifically, a blanket to be used in typical offset printing can be used.

Both the pressure relaxing layer and the cloth layer may be provided, one of these layers may be provided, or none of these layers may be provided. In addition, the pressure relaxing layer has a function as the heat insulating layer (second layer) in some cases.

Ink

An ink that has been widely used as an ink for an ink jet device can be used as the ink to be used in the present invention. Specifically, various inks obtained by dissolving and/or dispersing coloring materials such as a dye, carbon black, and an organic pigment can be used. Of those, a carbon black or organic pigment ink is particularly suitable because an image having good weatherability and good color developability is obtained. In addition, an aqueous ink containing water as a component is suitable from the viewpoints of its load on an environment and its odor at the time of its use. In particular, an ink containing 45 mass % or more of water in its components, especially, an ink whose solvent uses water as a main component is extremely preferred. Further, the coloring material content of the ink is preferably 0.1 mass % or more, more preferably 0.2 mass % or more, and is preferably 15.0 mass % or less, more preferably 10.0 mass % or less.

Examples of the coloring material include a dye, carbon black, an organic pigment, and a resin accompanying the foregoing, and those described below can be used.

Examples of the dye include: C.I. Direct Blue 6, 8, 22, 34, 70, 71, 76, 78, 86, 142, or 199; C.I. Acid Blue 9, 22, 40, 59, 93, 102, 104, 117, 120, 167, or 229; C.I. Direct Red 1, 4, 17, 28, 83, or 227; C.I. Acid Red 1, 4, 8, 13, 14, 15, 18, 21, 26, 35, 37, 249, 257, or 289; C.I. Direct Yellow 12, 24, 26, 86, 98, 132, or 142; C.I. Acid Yellow 1, 3, 4, 7, 11, 12, 13, 14, 19, 23, 25, 34, 44, or 71; C.I. Food Black 1 or 2; and C.I. Acid Black 2, 7, 24, 26, 31, 52, 112, or 118. In addition to the foregoing, any other known dye may be used.

Examples of the include carbon black pigments such as furnace black, lamp black, acetylene black, and channel black. For example, the following commercial products may be used. It should be noted that carbon black that may be used in the present invention is not limited to these carbon blacks, and any known carbon black may be used. In addition, a fine particle of a magnetic substance such as magnetite or ferrite, titanium black, or the like may be used.

Examples of the commercial products include: Raven: 7000, 5750, 5250, 5000, 3500, 2000, 1500, 1250, 1200, 1190 ULTRA-II, 1170, and 1255 (all of which are manufactured by Columbian Chemicals Co.); Black Pearls: L; Regal: 400R, 330R, and 660R; Mogul: L; Monarch: 700, 800, 880, 900, 1000, 1100, 1300, and 1400; Valcan: XC-72R (all of which are manufactured by Cabot Corporation); Color Black: FW1, FW2, FW2V, FW18, FW200, 5150, 5160, and 5170; Printex: 35, U, V, 140U, and 140V; Special Black: 6, 5, 4A, and 4 (all of which are manufactured by Degussa); and No. 25, No. 33, No. 40, No. 47, No. 52, No. 900, No. 2300, MCF-88, MA600, MA7, MA8, and MA100 (all of which are manufactured by Mitsubishi Chemical Corporation).

Examples of the organic pigment that may be used include: water-insoluble azo pigments such as Toluidine Red, Toluidine Maroon, Hansa Yellow, Benzidine Yellow, and Pyrazolone Red; water-soluble azo pigments such as Lithol Red, Helio Bordeaux, Pigment Scarlet, and Permanent Red 2B; derivatives of vat dyes such as alizarin, indanthrone, and Thioindigo Maroon; phthalocyanine-based pigments such as Phthalocyanine Blue and Phthalocyanine Green; quinacridone-based pigments such as Quinacridone Red and Quinacridone Magenta; perylene-based pigments such as Perylene Red and Perylene Scarlet; isoindolinone-based pigments such as Isoindolinone Yellow and Isoindolinone Orange; imidazolone-based pigments such as Benzimidazolone Yellow, Benzimidazolone Orange, and Benzimidazolone Red; pyranthrone-based pigments such as Pyranthrone Red and Pyranthrone Orange; indigo-based pigments; condensed azo-based pigments; thioindigo-based pigments; and Flavanthrone Yellow, Acylamide Yellow, Quinophthalone Yellow, Nickel Azo Yellow, Copper Azomethine Yellow, Perinone Orange, Anthrone Orange, Dianthraquinonyl Red, and Dioxazine Violet.

In addition, examples of the organic pigment that may be used, identified by a color index (C.I.) number, may include: C.I. Pigment Yellow: 12, 13, 14, 17, 20, 24, 74, 83, 86, 93, 109, 110, 117, 120, 125, 128, 137, 138, 147, 148, 151, 153, 154, 166, and 168; C.I. Pigment Orange: 16, 36, 43, 51, 55, 59, and 61; C.I. Pigment Red: 9, 48, 49, 52, 53, 57, 97, 122, 123, 149, 168, 175, 176, 177, 170, 192, 215, 216, 217, 220, 223, 224, 226, 227, 228, 238, and 240; C.I. Pigment Violet: 19, 23, 29, 30, 37, 40, and 50; C.I. Pigment Blue: 15, 15:3, 15:1, 15:4, 15:6, 22, 60, and 64; C.I. Pigment Green: 7 and 36; and C.I. Pigment Brown: 23, 25, and 26. Any known organic pigment other than the above-mentioned ones may be used.

The forms of those pigments are not limited, and a pigment of any one of, for example, a self-dispersion type, a resin dispersion type, and a microcapsule type can be used. A water-soluble dispersion resin having a weight-average molecular weight of 1,000 or more and 15,000 or less can be suitably used as a dispersant for the pigment to be used at that time. Specific examples thereof include a vinyl-based water-soluble resin, and block copolymers and random copolymers formed of styrene and a derivative thereof, vinylnaphthalene and a derivative thereof, an aliphatic alcohol ester of an α,β-ethylenically unsaturated carboxylic acid, acrylic acid and a derivative thereof, maleic acid and a derivative thereof, itaconic acid and a derivative thereof, and fumaric acid and a derivative thereof, and salts thereof.

In addition, a water-soluble resin or a water-soluble crosslinking agent can be added for improving the fastness of an image finally formed. The material to be used is not limited as long as the material can coexist with an ink component. Any one of the dispersion resins exemplified above can be used as it is as the water-soluble resin. Oxazoline or a carbodiimide is suitably used as the water-soluble crosslinking agent in terms of ink stability. A reactive oligomer such as polyethylene glycol diacrylate or acryloyl morpholine can also be suitably used.

In addition, in the present invention, the ink at the time of the transfer of the intermediate image from the intermediate transfer member onto the recording medium is formed substantially only of the coloring material and a high-boiling point organic solvent, and hence it is effective to incorporate a proper amount of an organic solvent for improving the transferability. The organic solvent to be used is preferably a water-soluble material having a high boiling point and a low vapor pressure. Examples thereof can include the following organic solvents: alkanediols such as 1,3-butanediol, 1,5-pentanediol, 1,2-hexanediol, and 1,6-hexanediol; glycol ethers such as diethylene glycol monomethyl(or ethyl)ether and triethylene glycol monoethyl(or butyl)ether; alkyl alcohols having 1 to 4 carbon atoms such as ethanol, isopropanol, n-butanol, isobutanol, secondary butanol, and tertiary butanol; carboxylic acid amides such as N,N-dimethylformamide and N,N-dimethylacetamide; ketones or keto alcohols such as acetone, methyl ethyl ketone, and 2-methyl-2-hydroxypentan-4-one; cyclic ethers such as tetrahydrofuran and dioxane; glycerin; alkylene glycols such as ethylene glycol, diethylene glycol, triethylene glycol, tetraethylene glycol, 1,2- or 1,3-propylene glycol, 1,2- or 1,4-butylene glycol, and polyethylene glycol; polyhydric alcohols such as thiodiglycol and 1,2,6-hexanetriol; heterocycles such as 2-pyrrolidone, N-methyl-2-pyrrolidone, 1,3-dimethyl-2-imidazolidinone, and N-methylmorpholine; and sulfur-containing compounds such as dimethyl sulfoxide. In addition, two or more kinds may be selected from those organic solvents and used as a mixture.

In addition, the ink to be used in the present invention may contain any of various additives such as a pH adjustor, an anti-rust agent, an antiseptic, a mildewproofing agent, an antioxidant, an anti-reduction agent, a neutralizer for an aqueous resin, and a salt as required in addition to the above-mentioned components.

It is also preferred that a surfactant be added as required to appropriately adjust the surface tension of the ink before its use. The surfactant is not limited as long as the surfactant does not adversely affect the storage stability and the like of the ink. Examples of the surfactant include anionic surfactants such as fatty acid salts, higher alcohol sulfuric acid ester salts, liquid fatty oil sulfuric acid ester salts, and alkyl aryl sulfonate salts; and nonionic surfactants such as polyoxyethylene alkyl esters, polyoxyethylene sorbitan alkyl esters, acetylene alcohols, and acetylene glycols. In addition, two or more kinds appropriately selected from those surfactants may be used.

The blending ratio between the components constituting the ink is not limited, and can be appropriately adjusted according to the ejection force, nozzle diameter, and the like of the selected ink jet head as long as the ink can be ejected from the head.

Treatment Liquid

In the present invention, when an intermediate image is formed from an ink and a treatment liquid, the ink and the treatment liquid are applied onto the image forming surface of the intermediate transfer member simultaneously or at different moments. Thus, the treatment liquid and the ink are brought into contact with each other on the surface of the intermediate transfer member. At this time, the ink undergoes, for example, a reaction or physical interaction with the treatment liquid to agglomerate, which results in viscosity increase. The ink image thus increased in viscosity is formed as the intermediate image. It should be noted that at the time of the formation of the intermediate image, the intermediate image is formed on the intermediate transfer member as an image obtained by reversing a desired image (mirror image).

The treatment liquid in the present invention contains a component for increasing the viscosity of the ink (ink-viscosity-increasing component). Here, the viscosity increase of the ink occurs, for example, when the coloring material, resin, or the like as part of the composition constituting the ink is brought into contact with the ink-viscosity-increasing component to chemically react therewith or physically adsorbs thereto. In addition, the viscosity increase of the ink occurs through the occurrence of a local viscosity increase caused by the agglomeration of part of the ink composition such as the coloring material.

The treatment liquid has the following effect: the liquid reduces the flowability of part of the ink and/or ink composition on the intermediate transfer member to suppress bleeding and beading at the time of the image formation. That is to say, in the image formation with the transfer image forming apparatus of the present invention, the amount of the applied ink per unit area becomes large in some cases. In such cases, the bleeding or beading, which is blurring or mixing of inks, is liable to occur. However, even when the amount of the applied ink is large as described above, the application of the treatment liquid onto the intermediate transfer member reduces the flowability of the ink at the time of the image formation. Accordingly, the bleeding or the beading hardly occurs, whereby the image is satisfactorily formed and held.

It is desired that the ink-viscosity-increasing component to be used in the treatment liquid be properly selected depending on the kind of the ink to be used in the image formation. For example, it is effective to use a high-molecular weight agglomerating agent for a dye-based ink. In addition, it is effective to use a liquid containing a polyvalent metal ion or a pH adjustor such as an acid buffer for a pigment-based ink in which a fine particle has been dispersed. It is also desired to use a compound having multiple ionic groups such as a cation polymer as another example of the ink-viscosity-increasing component. Further, it is also effective to use two or more kinds of those compounds in combination.

Examples of the high-molecular weight agglomerating agent that can be used as the ink-viscosity-increasing component include a cationic high-molecular weight agglomerating agent, an anionic high-molecular weight agglomerating agent, a nonionic high-molecular weight agglomerating agent, and an amphoteric high-molecular weight agglomerating agent.

In addition, examples of the metal ion that can be used as the ink-viscosity-increasing component include, but not limited to, divalent metal ions and trivalent metal ions. Examples of the divalent metal ions can include $Ca^{2+}$, $Cu^{2+}$, $Ni^{2+}$, $Mg^{2+}$, $Sr^{2+}$, $Ba^{2+}$, and $Zn^{2+}$, and examples of the trivalent metal ions can include $Fe^{3+}$, $Cr^{3+}$, $Y^{3+}$, and $Al^{3+}$. In addition, when the treatment liquid containing any such metal ion is applied onto the intermediate transfer member, the liquid is desirably applied as an aqueous solution of a metal salt. Examples of the anion of the metal salt include, but not limited to, $Cl^-$, $NO_3^-$, $CO_3^{2-}$, $SO_4^{2-}$, $I^-$, $Br^-$, $ClO_3^-$, $HCOO^-$, and $RCOO^-$ (where R represents an alkyl group). The metal salt concentration of the metal salt aqueous solution is preferably 0.01 mass % or more, more preferably 0.1 mass % or more. In addition, the concentration is preferably 20 mass % or less.

In addition, an acidic solution having a pH of less than 7 is suitably used as the pH adjustor that can be used as the ink-viscosity-increasing component. Examples of the pH adjustor include inorganic acids such as hydrochloric acid, phosphoric acid, sulfuric acid, nitric acid, and boric acid; and organic acids such as oxalic acid, polyacrylic acid, acetic acid, glycolic acid, levulinic acid, malonic acid, malic acid, maleic acid, ascorbic acid, succinic acid, glutaric acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumaric acid, thiophenecarboxylic acid, and nicotinic acid. In addition, a derivative of any such compound or a solution of a salt thereof may be preferably used as well.

The acid buffer having a pH buffering ability is extremely suitably used because of the following reason: even when the apparent concentration of the ink-viscosity-increasing component in the treatment liquid reduces owing to contact with the ink, the fluctuation in pH is small and hence, for example, its reactivity with the ink does not weaken. Therefore, a buffering agent is preferably incorporated into the treatment liquid for obtaining a pH buffering ability. Specific examples of the buffering agent may include: acetic acid salts such as sodium acetate, potassium acetate, and lithium acetate; hydrogen phosphate salts, hydrogen carbonate salts, and hydrogen salts of a polycarboxylic acid such as sodium hydrogen phthalate and potassium hydrogen phthalate. Further, specific examples of the polycarboxylic acid include malonic acid, maleic acid, succinic acid, fumaric acid, itaconic acid, phthalic acid, isophthalic acid, terephthalic acid, adipic acid, sebacic acid, a dimeric acid, pyromellitic acid, and trimellitic acid in addition to phthalic acid. In addition to the foregoing, any one of the conventionally known compounds the addition of which expresses a buffering action on a pH can be suitably used.

In addition, the treatment liquid to be used in the present invention may contain an appropriate amount of water or an organic solvent. The treatment liquid may contain an aqueous medium. Examples of the aqueous medium include water, and a mixed solvent of water and a water-soluble organic solvent. Specific examples thereof can include the following aqueous media: alkanediols such as 1,3-butanediol, 1,5-pentanediol, 1,2-hexanediol, and 1,6-hexanediol; glycol ethers such as diethylene glycol monomethyl(or ethyl)ether and triethylene glycol monoethyl(or butyl)ether; alkyl alcohol having 1 to 4 carbon atoms such as ethanol, isopropanol, n-butanol, isobutanol, secondary butanol, and tertiary butanol; carboxylic acid amides such as N,N-dimethylformamide and N,N-dimethylacetamide; ketones or keto alcohols such as acetone, methyl ethyl ketone, and 2-methyl-2-hydroxypentan-4-one; cyclic ethers such as tetrahydrofuran and dioxane; glycerin; alkylene glycols such as ethylene glycol, diethylene glycol, triethylene glycol, tetraethylene glycol, 1,2- or 1,3-propylene glycol, 1,2- or 1,4-butylene glycol, and polyethylene glycol; polyhydric alcohols such as thiodiglycol, 1,2,6-hexanetriol, and an acetylene glycol derivative; sulfur-containing compounds such as 2-pyrrolidone, N-methyl-2-pyrrolidone, 1,3-dimethyl-2-imidazolidinone, and dimethyl sulfoxide. In addition, two or more kinds may be selected from those aqueous media and used as a mixture.

In addition to the foregoing components, a defoaming agent, an antiseptic, a mildewproofing agent, or the like can be appropriately added to the treatment liquid for imparting desired property to the liquid as required.

In addition, various resins can be added to the treatment liquid for improving the transferability or for improving the fastness of the image finally formed. The addition of a resin can improve the adhesion property to the recording medium at the time of the transfer or can increase the mechanical strength of an ink coating film. In addition, the selection of a proper resin can improve the water resistance of the image. The material to be used in the resin is not particularly limited as long as the material can coexist with the ink-viscosity-increasing component. For example, an organic polymer such as polyvinyl alcohol or polyvinylpyrrolidone is suitably used as the resin. A resin that reacts with a component in the ink to crosslink is also suitable. Examples of such resin that crosslinks include oxazoline and a carbodiimide each of which reacts with a carboxylic acid, which is frequently used for the dispersion of the coloring material in the ink, to crosslink. Any such resin may be dissolved in the solvent constituting the treatment liquid before use, or may be added in an emulsion state or a suspension state to the treatment liquid before use.

In addition, the surface tension of the treatment liquid can be appropriately adjusted before use by adding a surfactant. A known surfactant such as an ionic, nonionic, cationic, and anionic surfactant can be appropriately selected and used as the surfactant as required.

Recording Medium

Although the material and shape of the recording medium are not particularly limited, not only paper to be used in general printing but also, for example, a wide range of printing media and recording media including a cloth, a plastic, and a film can be used. A continuous or roll-shaped sheet, or a single-substrate sheet cut into a specified shape can also be used.

2. Transfer Image Forming Method

Hereinafter, the transfer image forming method according to an embodiment of the present invention is described in detail.

Treatment Liquid Applying Step

Various conventionally known approaches can be appropriately employed in the treatment liquid applying step. Examples of the treatment liquid applying step include die coating, blade coating, and a gravure roller, and a combination of any one of the foregoing with an offset roller. It is also extremely suitable to use an ink jet device as a means by which the liquid can be applied at a high speed with high accuracy.

Intermediate Image Forming Step

An intermediate image is formed by applying ink onto an intermediate transfer member with an ink applying unit. It should be noted that when the ink and the treatment liquid are brought into contact with each other on the intermediate transfer member, for example, the treatment liquid is applied onto the intermediate transfer member with the treatment liquid applying unit in advance, and then the ink is applied onto the intermediate transfer member with the ink applying unit so as to be brought into contact with the treatment liquid. The ink applying unit can be, for example, an ink jet device. Any one of the various ink jet devices proposed in an ink jet liquid ejection technology can be used as the ink jet device. Specifically, there may be mentioned a device which applies the ink by forming air bubbles through the occurrence of the film boiling of the ink with an electrothermal converter. In addition to the foregoing, examples of the ink jet device can include a device of such a form that ink is applied with an electromechanical converter and a device of such a form that ink is ejected by utilizing static electricity. Of those, a device utilizing an electrothermal converter is suitably used particularly from the viewpoint of high-speed and high-density printing. In addition, the device construction of the ink jet device is not particularly limited. For example, a line head-shaped ink jet head obtained by arraying ink ejection orifices in the travelling direction of the intermediate transfer member (in the case of a drum shape, in sits axial direction) can be used. A shuttle-shaped ink jet head that performs recording while scanning vertically to the travelling direction of the intermediate transfer member can also be used.

Liquid Component Removing Step

In the transfer image forming method of the present invention, after the formation of the intermediate image on the intermediate transfer member, the step of reducing the amount of a liquid component from the intermediate image is preferably provided. When the amount of the liquid component in the intermediate image is excessive, the redundant liquid protrudes or overflows in the subsequent transferring step to disturb the intermediate image, with the result that a transfer failure occurs in some cases. It should be noted that any one of the various approaches that have been conventionally employed can be suitably applied as a method of removing the liquid component. Specifically, any one of a method based on heating, a method involving blowing low-humidity air, a method involving a pressure reduction, a method involving bringing an absorbent into contact, and an approach obtained by combining two or more of the methods is suitably employed as the liquid component removing step. A method based on air drying can also be employed. The liquid component removing step may be performed as part of the heating step to be described later.

Heating Step

The heating of the intermediate image formed on the intermediate transfer member with the ink facilitates the transfer of the intermediate image from the intermediate transfer member onto the recording medium. At this time, particularly when the content of a high-molecular weight component in the ink is large, the high-molecular weight component softens due to heat to enlarge the adhesive force of the intermediate image to the recording medium. A method involving heating from an outside with respect to the surface of the intermediate transfer member is employed as the heating step. Specifically, the step of irradiating the intermediate transfer member with infrared light to heat the member is performed. The reason for the foregoing is as described below.

That is to say, in the transfer image forming method in which the intermediate image is formed on the intermediate transfer member and then the intermediate image is transferred onto the recording medium like the present invention, the time period for which the ink constituting the intermediate image is heated shortens. In particular, when high-speed image formation is performed, the time period for which the ink is heated shortens remarkably. Meanwhile, in order that the transferability of the intermediate image be improved in the subsequent transferring step or the intermediate image may be cooled at the time of the transfer, the temperature of the intermediate image needs to be increased by heating the surface of the intermediate transfer member. Therefore, a heating method by which the temperature of the intermediate image on the intermediate transfer member is sharply increased within a short time period needs to be employed. In view of the foregoing, in the present invention, the temperature of the intermediate image on the intermediate transfer member can be sharply increased within a short time period by adopting the heating step based on infrared light irradiation.

In addition, when the intermediate image is heated by the infrared light irradiation, the heat capacity of the surface layer is preferably substantially small. To that end, the thickness of the surface layer is desirably relatively small, provided that the surface layer portion needs to have some degree of thickness because an improvement in transferability of the intermediate image requires the adhesiveness of the surface layer of the intermediate transfer member with respect to the recording medium.

Transferring Step

In the transferring step, the intermediate image is transferred from the intermediate transfer member onto the recording medium by pressing the intermediate image on the intermediate transfer member against the recording medium. Thus, an image-printed product is obtained. In the transferring step, it is suitable that pressurization is performed from both sides of the intermediate transfer member and the recording medium with the pressure roller because the intermediate image is efficiently transferred and formed onto the recording medium. At the time of the transferring step, the ink image (intermediate image) is heated and then adheres in a softened stated to the surface of the recording medium. After that, the cohesive force of an ink agglomerate increases through heat absorption by the recording medium, which facilitates the detachment of the image from the surface of the intermediate transfer member. Here, in the present invention, the temperatures of the surface layer of the intermediate transfer member and the intermediate image on the surface layer can be sharply reduced at the time of the transfer because the heat conductivity of the second layer under the metal layer constituting the intermediate transfer member is lower than that of the first layer. That is to say, the heat conductivity of the second layer constituting the intermediate transfer member is smaller than that of the first layer, and hence heat in the first layer can be easily conducted to the recording medium side while the flow of heat from the second layer to the first layer is suppressed. As a result, the transferability of the intermediate image from the intermediate transfer member onto the recording medium can be additionally improved.

Further, a value obtained by dividing the heat conductivity of the second layer by its thickness, i.e. (heat conductivity of the second layer)/(thickness of the second layer), is preferably equal to or less than a value obtained by dividing the heat conductivity of the first layer by its thickness, i.e. (heat conductivity of the first layer)/(thickness of the first layer). When this relational expression is satisfied, an improving effect on the transferability is obtained at a higher level, and when a printing operation is continuously performed, the temperature management of the intermediate transfer member becomes more stable.

Washing and Reproducing Step

Although the image formation can be completed through the above-mentioned steps, the intermediate transfer member is repeatedly and continuously used from the viewpoint of productivity in some cases. At this time, the surface of the intermediate transfer member is preferably washed and reproduced before the performance of next image formation. Various methods that have been conventionally employed can be suitably applied as a method for performing the washing and reproduction of the intermediate transfer member. Specifically, a method involving bringing a washing liquid into contact in a shower manner with the surface of the intermediate transfer member or a method involving causing a wet molten roller to abut on the surface of the intermediate transfer member for wiping out is suitably employed. In addition, a method involving bringing the surface of the intermediate transfer member into contact with a washing liquid surface, a method involving raking on the surface of the intermediate transfer member with a wiper blade, a method involving applying various energies to the surface of the intermediate transfer member, or the like is suitably employed. A method of combining two or more of those methods is also suitable.

Cooling Step

When high-speed printing is performed by employing the method of the present invention, cooling performance after the heating of the intermediate transfer member is important. That is to say, when the high-speed printing is performed, the surface temperature of the intermediate transfer member after the transferring step becomes higher than the surface temperature of the intermediate transfer member before the application of the ink or the treatment liquid. Accordingly, when the ink or the treatment liquid is applied to the intermediate transfer member again, a condition for the application changes, which may adversely affect an image to be formed in the drawing (intermediate image forming) step. In addition, when the high-speed printing is repeatedly performed, the surface temperature of the intermediate transfer member may increase every time the printing is performed.

In view of the foregoing, the step of cooling the intermediate transfer member is preferably provided, for example, when the high-speed printing is repeatedly performed. However, when a time period from the transferring step to the cooling step is long, heat accumulation occurs on the substrate side constituting the intermediate transfer member to increase the temperature. As a result, it becomes difficult to control the temperature to a stable state; for example, the temperature of the intermediate transfer member becomes higher than a desired temperature. Therefore, when the cooling step is provided, the surface temperature of the intermediate transfer member is preferably reset by cooling the intermediate transfer member immediately after the completion of the transferring step. Here, in the present invention, the heat conductivity of the second layer constituting the intermediate transfer member is smaller than that of the first layer. Accordingly, the surface temperature of the intermediate transfer member can be rapidly cooled and reset by directly cooling the surface layer portion of the intermediate transfer member. Thus, a stable image can be obtained even when printing is continuously performed at a high speed.

A specific cooling method is preferably of such a construction that the cooling belt is in direct contact with the surface layer of the intermediate transfer member for a certain time period. A silicone rubber is preferably used as the cooling belt because of its high heat conductivity and good cooling performance. In addition, the cooling step can be performed simultaneously with the washing and reproducing step.

Temperature Management of Intermediate Transfer Member

As described above, the temperature of the surface of the intermediate transfer member is preferably managed to fall within a predetermined range from the viewpoint of improving the transferability. Specifically, the surface temperature of the intermediate transfer member is set to such a temperature as described below.

(1) At the time of the application of the treatment liquid: About 50 to 60° C.

It should be noted that the application of the treatment liquid causes a slight reduction in temperature of the surface of the intermediate transfer member but the reduction causes no particular problem.

(2) At the time of the drawing (intermediate image formation): About 50 to 60° C.

(3) At the time of the heating: The intermediate transfer member includes the surface layer having a relatively low heat capacity on the metal layer and the heat insulating layer under the metal layer, and hence the temperature of the surface layer can be abruptly increased. Specifically, the temperature of the surface layer can be increased to about 80 to 90° C. within a short time period.

(4) At the time of the transfer: The temperature of the surface layer easily reduces through its contact with paper (recording medium) because the surface layer is reduced in heat capacity. In actuality, the temperature of the surface layer reduces by about 5 to 10° C. at the time of the transfer.

(5) At the time of the cooling: The temperature is reduced to that before the application of the treatment liquid, i.e., 50 to 60° C. The surface layer temperature of the intermediate transfer member can be reduced in a relatively quick manner because the surface layer is reduced in heat capacity. When the surface layer temperature of the intermediate transfer member is monitored and is not reset to a temperature of about 50 to 60° C., it is preferred to interrupt the recording cycle and wait until the temperature stabilizes at a predetermined temperature.

Fixing Step

As an additional step, the surface smoothness of the recording medium on which the image has been formed may be improved by pressurizing the medium with a roller after the transferring step. In addition, at this time, heating the roller may improve the fastness of the image. Therefore, a fixing step can be suitably provided.

It should be noted that conditions to be used in the transfer image forming method of the present invention are described in detail by being exemplified in Examples below.

Hereinafter, the transfer image forming method, transfer image forming apparatus, and intermediate transfer member of the present invention are described more specifically by way of Examples and Comparative Examples. Of course, the present invention is not limited to Examples below.

EXAMPLE 1

In this example, the transfer image forming apparatus illustrated in FIG. 1 was used. A member having the layer construction of FIG. 3 was used as the intermediate transfer member 11 of the transfer image forming apparatus. That is to say, in the intermediate transfer member 11, the surface layer (first layer), the metal layer, the heat insulating layer (second layer), the pressure relaxing layer, and the substrate 12 are placed in the stated order from the surface side of the intermediate transfer member 11. A cylindrical drum formed of an aluminum alloy was used as the substrate 12. Hereinafter, the construction of each layer on the substrate 12 is described.

(i) Surface Layer (First Layer)

Used in this example was a surface layer obtained by coating a PET sheet having a thickness of 0.5 mm with a 0.2-mm thick layer of a silicone rubber having a rubber hardness of 40° (KE12 manufactured by Shin-Etsu Chemical Co., Ltd.); and then detaching the layer from the PET sheet. The heat conductivity of the surface layer was set to 0.16 (W/m·K). The surface of the surface layer was subjected to surface modification with an atmospheric plasma treatment apparatus (ST-7000 manufactured by KEYENCE CORPORATION) under the following conditions.

Treatment distance: 5 mm
Plasma mode: High
Treatment speed: 100 mm/sec

Further, the surface was immersed in a surfactant aqueous solution, which was obtained by diluting a commercial neutral detergent formed of a sodium alkylbenzenesulfonate with pure water so that the concentration of the resultant became 3 mass %, for 10 seconds. After that, the surface was washed with water and dried before the surface layer was used.

(ii) Metal Layer

A stainless steel foil having a thickness of 100 μm was used.

(iii) Heat Insulating Layer (Second Layer)

A rigid urethane foam having a thickness of 0.1 mm (heat conductivity: 0.026 W/m·K) was used.

(iv) Pressure Relaxing Layer

An NBR having a heat conductivity of 0.2 W/m·K and a thickness of 1 mm was used. According to this construction, (heat conductivity)/(thickness) of the second layer is 260 ($W/m^2 \cdot K$), which is a value smaller than (heat conductivity)/(thickness) of the first layer, i.e., 800 ($W/m^2 \cdot K$).

Used as a treatment liquid in this example was a liquid obtained by appropriately adding a surfactant to an aqueous solution of a metal salt, specifically, a 10-mass % aqueous solution of calcium chloride ($CaCl_2.2H_2O$) to adjust its surface tension. It should be noted that the kind and concentration of the metal can be appropriately changed depending on conditions.

In this example, a resin dispersion type pigment ink was prepared and used as an ink. The composition of the ink is described below. It should be noted that the term "part(s)" in the following composition represents "part(s) by mass."

| | |
|---|---|
| Pigment coloring material: C.I. Pigment Blue 15 | 3.0 parts |
| Dispersion resin: styrene-acrylic acid-ethyl acrylate copolymer (acid value: 240, weight-average molecular weight: 5,000) | 1.0 part |
| Nonaqueous solvent 1: glycerin | 10.0 parts |
| Nonaqueous solvent 2: ethylene glycol | 5.0 parts |
| Surfactant: Acetylenol E100 (trade name) | 0.5 part |
| Ion-exchanged water: | 80.5 parts |

EXAMPLE 2

The same apparatus as that of Example 1 was used except that the intermediate transfer member 11 was changed to the following member corresponding to that having the layer construction of FIG. 2.

(i) Surface Layer (First Layer)

The same layer as that of Example 1 was used.

(ii) Metal Layer

Gold having a thickness of 30 μm was used.

(iii) Heat Insulating Layer (Second Layer)

Foamed polystyrene having a thickness of 0.5 mm (heat conductivity: 0.03 W/m·K) was used. Although no pressure relaxing layer is provided here, the heat insulating layer has elasticity because a foaming material is used in the layer. According to this construction, (heat conductivity)/(thickness) of the second layer is 60 ($W/m^2 \cdot K$), which is a value smaller than (heat conductivity)/(thickness) of the first layer, i.e., 800 ($W/m^2 \cdot K$).

EXAMPLE 3

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 30 μm was used.

(iii) Heat Insulating Layer (Second Layer)

Foamed polystyrene having a thickness of 0.1 mm (heat conductivity: 0.03 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 300 ($W/m^2 \cdot K$), which is a value smaller than (heat conductivity)/(thickness) of the first layer, i.e., 800 ($W/m^2 \cdot K$).

EXAMPLE 4

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

An aluminum foil having a thickness of 60 μm was used.

(iii) Heat Insulating Layer (Second Layer)

Foamed polystyrene having a thickness of 0.1 mm (heat conductivity: 0.03 W/m·K) was used.

(iv) Pressure Relaxing Layer (Third Layer)

An NBR having a thickness of 1 mm (heat conductivity: 0.2 W/m·K) was used. According to this construction, (heat conductivity)/(thickness) of the second layer is 300 ($W/m^2 \cdot K$), which is a value smaller than (heat conductivity)/(thickness) of the first layer, i.e., 800 ($W/m^2 \cdot K$).

EXAMPLE 5

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 30 μm was used.

(iii) Heat Insulating Layer (Second Layer)

A foamed silicone having a thickness of 0.1 mm (heat conductivity: 0.06 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 600 ($W/m^2 \cdot K$), which is a value smaller than (heat conductivity)/(thickness) of the first layer, i.e., 800 ($W/m^2 \cdot K$).

EXAMPLE 6

The same apparatus as that of Example 1 was used except that the intermediate transfer member 11 was changed to the following member corresponding to that having the layer construction of FIG. 3.

(i) Surface Layer (First Layer)

Here, the thickness of the silicone rubber of Example 1 was changed to 0.1 mm.

(ii) Metal Layer

Gold having a thickness of 30 μm was used.

(iii) Heat Insulating Layer (Second Layer)

A foamed silicone having a thickness of 0.1 mm (heat conductivity: 0.06 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 600 ($W/m^2 \cdot K$), which is a value smaller than (heat conductivity)/(thickness) of the first layer, i.e., 1,600 ($W/m^2 \cdot K$).

EXAMPLE 7

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 20 μm was used.

(iii) Heat Insulating Layer (Second Layer)

A foamed silicone having a thickness of 0.1 mm (heat conductivity: 0.06 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 600 ($W/m^2 \cdot K$), which is a value smaller than (heat conductivity)/(thickness) of the first layer, i.e., 800 ($W/m^2 \cdot K$).

EXAMPLE 8

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 10 μm was used.

(iii) Heat Insulating Layer (Second Layer)

A foamed silicone having a thickness of 0.1 mm (heat conductivity: 0.06 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 600 ($W/m^2 \cdot K$), which is a value smaller than (heat conductivity)/(thickness) of the first layer, i.e., 800 ($W/m^2 \cdot K$).

EXAMPLE 9

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 1 μm was used.

(iii) Heat Insulating Layer (Second Layer)

A foamed silicone having a thickness of 0.1 mm (heat conductivity: 0.06 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 600 ($W/m^2 \cdot K$), which is a value smaller than (heat conductivity)/(thickness) of the first layer, i.e., 800 ($W/m^2 \cdot K$).

EXAMPLE 10

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 0.3 μm was used.

(iii) Heat Insulating Layer (Second Layer)

A foamed silicone having a thickness of 0.1 mm and having a foaming property which is different from that of Example 9 (heat conductivity: 0.08 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 800 ($W/m^2 \cdot K$), which is the same value as (heat conductivity)/(thickness) of the first layer, i.e., 800 ($W/m^2 \cdot K$).

EXAMPLE 11

The same apparatus as that of Example 1 was used except that the intermediate transfer member 11 was changed to the following member corresponding to that having the layer construction of FIG. 3.

(i) Surface Layer (First Layer)

The same layer as that of Example 1 was used.

(ii) Metal Layer

Gold having a thickness of 10 μm was used.

(iii) Heat Insulating Layer (Second Layer)

The same foamed silicone as that of Example 9 having a thickness of 0.2 mm (heat conductivity: 0.08 W/m·K) was used.

(iv) Pressure Relaxing Layer (Third Layer)

An NBR having a thickness of 1 mm (heat conductivity: 0.2 W/m·K) was used.

According to this construction, (heat conductivity)/(thickness) of the second layer is 400 ($W/m^2 \cdot K$), which is a value smaller than (heat conductivity)/(thickness) of the first layer, i.e., 800 ($W/m^2 \cdot K$).

Comparative Example 1

The same apparatus as that of Example 1 was used except that the layers on the substrate of the intermediate transfer member 11 were changed to layers of the following layer constructions.

(i) Surface Layer

The same layer as that of Example 1 was used.

(ii) Intermediate Layer

An epoxy resin having a thickness of 0.1 mm (heat conductivity: 0.21 W/m·K) was used.

(iii) Pressure Relaxing Layer (Third Layer)

An NBR having a thickness of 1 mm (heat conductivity: 0.2 W/m·K) was used.

Comparative Example 2

The same apparatus as that of Example 1 was used except that the layers on the substrate of the intermediate transfer member 11 were changed to layers of the following layer constructions.

(i) Surface Layer

The same layer as that of Example 1 was used.

(ii) Heat Insulating Layer

Foamed polystyrene having a thickness of 0.1 mm (heat conductivity: 0.03 W/m·K) was used.

(iii) Pressure Relaxing Layer (Third Layer)

An NBR having a thickness of 1 mm (heat conductivity: 0.2 W/m·K) was used.

A transfer experiment was performed with the apparatus of FIG. 1 including the intermediate transfer members of Examples 1 to 4, and Comparative Examples 1 and 2. It should be noted that the substrates used in Examples 1 to 4 and Comparative Examples 1 and 2 were the same. An Aurora Coat Paper sheet (manufactured by Nippon Paper Industries Co., Ltd.) and a PET film (thickness: 150 μm) whose surface had been subjected to a hydrophilic treatment were used as recording media. Then, transferability was evaluated according to the following evaluation criteria.

AA: No transfer residue is visually observed on the surface layer of the intermediate transfer member.

A: The ink is visually observed to remain slightly on the surface layer of the intermediate transfer member, but has no influence on the image.

B: The ink is visually observed to remain slightly on the surface layer of the intermediate transfer member, and slight lacks of the image is visually observed.

C: The ink is visually observed to remain clearly on the surface layer of the intermediate transfer member.

Transferability in continuous printing during a time period from the initial stage of printing to 1 hour thereafter, and transferability in continuous printing during a time period from 1 hour after the initiation of the printing to 2 hours thereafter were evaluated. Table 1 shows the results of the evaluation.

TABLE 1

| | Transferability (initial stage to 1 hour) | Transferability (1 hour to 2 hours) |
|---|---|---|
| Example 1 | AA | AA |
| Example 2 | AA | AA |
| Example 3 | AA | AA |
| Example 4 | AA | AA |
| Example 5 | AA | AA to A |
| Example 6 | AA | AA to A |
| Example 7 | AA | AA to A |
| Example 8 | AA | AA to A |
| Example 9 | AA | AA to A |
| Example 10 | AA | A |
| Example 11 | AA | AA |
| Comparative Example 1 | B to C | C |
| Comparative Example 2 | B | B |

In Examples 1 to 11, and Comparative Examples 1 and 2, the temperature of the cooling belt was set to 25 to 50° C., and the surface temperature of the intermediate transfer member, which had been 80° C. after the transferring step, reduced to 50° C.

In Examples 1 to 11, each of the transferability (initial stage to 1 hour) and the transferability (1 hour to 2 hours) was evaluated as "A" or "AA". In contrast, in Comparative Examples 1 and 2, each of the transferabilities was evaluated as "B" or "C", and was not evaluated as "A". As is apparent from the results of Table 1, in the present invention, even when the continuous printing was performed, good transferability was continuously obtained during a time period from the initial stage to 2 hours thereafter.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-040716, filed Mar. 1, 2013, and Japanese Patent Application No. 2013-022272, filed Feb. 7, 2013, which are hereby incorporated by reference herein in their entirety.

What is claimed is:

1. A transfer image forming apparatus, comprising:

an ink applying unit for applying ink to an intermediate transfer member to form an intermediate image;

a heating unit for irradiating the intermediate transfer member with at least infrared light to heat the intermediate image; and a transferring unit for pressing a recording medium against the intermediate transfer member having formed thereon the intermediate image to transfer the intermediate image onto the recording medium, wherein the intermediate transfer member includes a substrate, and at least a third layer, a second layer, a metal layer, and a first layer as a surface layer provided in the listed order on the substrate, and wherein a heat conductivity of the second layer is smaller than a heat conductivity of the first layer and a heat conductivity of the third layer.

2. A transfer image forming apparatus according to claim 1, further comprising a treatment liquid applying unit for applying a treatment liquid for increasing a viscosity of the ink.

3. A transfer image forming apparatus according to claim 1, wherein the intermediate image contains a resin.

4. An intermediate transfer member for a transfer image forming apparatus comprising an ink applying unit for applying ink to an intermediate transfer member to form an intermediate image; a heating unit for irradiating the intermediate transfer member with at least infrared light to heat the intermediate image; and a transferring unit for pressing a recording medium against the intermediate transfer member having formed thereon the intermediate image to transfer the intermediate image onto the recording medium, wherein the intermediate transfer member comprises a substrate, and at least a third layer, a second layer, a metal layer, and a first layer as a surface layer provided in the listed order on the substrate, and wherein a heat conductivity of the second layer is smaller than a heat conductivity of the first layer and a heat conductivity of the third layer.

5. A transfer image forming method, comprising:

an intermediate image forming step of applying ink to an intermediate transfer member to form an intermediate image;

a heating step of irradiating the intermediate transfer member with at least infrared light to heat the intermediate image; and a transferring step of pressing a recording medium against the intermediate transfer member having formed thereon the intermediate image to transfer the intermediate image onto the recording medium, wherein the intermediate transfer member includes a substrate, and at least a third layer, a second layer, a metal layer, and a first layer as a surface layer provided in the listed order on the substrate, and wherein a heat conductivity of the second layer is smaller than a heat conductivity of the first layer and a heat conductivity of the third layer.

6. A transfer image forming method according to claim 5, further comprising a treatment liquid applying step of applying a treatment liquid for increasing a viscosity of the ink.

7. A transfer image forming method according to claim 5, wherein the intermediate image contains a resin.

* * * * *